US008683652B2

(12) United States Patent
Hagspiel

(10) Patent No.: US 8,683,652 B2
(45) Date of Patent: Apr. 1, 2014

(54) FURNITURE HINGE

(71) Applicant: Julius Blum GmbH, Hochst (AT)

(72) Inventor: Dominik Hagspiel, Hochst (AT)

(73) Assignee: Julius Blum GmbH, Hochst (AT)

( * ) Notice: Subject to any disclaimer, the term of this patent is extended or adjusted under 35 U.S.C. 154(b) by 0 days.

(21) Appl. No.: 13/952,832

(22) Filed: Jul. 29, 2013

(65) Prior Publication Data

US 2013/0305487 A1 Nov. 21, 2013

Related U.S. Application Data

(63) Continuation of application No. PCT/AT2011/000501, filed on Dec. 20, 2011.

(30) Foreign Application Priority Data

Feb. 9, 2011 (AT) ..... 170/2011

(51) Int. Cl.
*E05D 7/04* (2006.01)

(52) U.S. Cl.
USPC ..... 16/238; 16/236; 16/240; 16/245; 16/374; 16/382

(58) Field of Classification Search
USPC ..... 16/238, 235, 236, 240, 242, 243, 245, 16/246, 382, 374, 239
See application file for complete search history.

(56) References Cited

U.S. PATENT DOCUMENTS 4,703,539 A * 11/1987 Lautenschlager et al. ..... 16/240
4,976,006 A * 12/1990 Lautenschlager ..... 16/238
5,412,840 A * 5/1995 Lautenschlager et al. ..... 16/238
5,511,287 A * 4/1996 Lautenschlager et al. ..... 16/239
5,920,958 A * 7/1999 Domenig et al. ..... 16/237
6,339,864 B1 * 1/2002 Albrecht et al. ..... 16/258
6,442,798 B1 9/2002 Rupprechter (Continued)

FOREIGN PATENT DOCUMENTS

DE 2806958 A * 8/1978
DE 203 19 539 3/2004

(Continued)

OTHER PUBLICATIONS

International Search Report (ISR) issued Mar. 29, 2013 in International (PCT) Application No. PCT/AT2011/000501.
Austrian Patent Office Search Report (ASR) issued Sep. 26, 2011 in Austrian Patent Application No. A 170/2011.

*Primary Examiner* — Chuck Mah
(74) *Attorney, Agent, or Firm* — Wenderoth, Lind & Ponack, L.L.P.

(57) ABSTRACT

The invention relates to a furniture hinge comprising a base plate, which is designed to be fastened to a furniture body, and a hinge arm that is mounted so as to be movable by an adjustment device in a controlled manner relative to the base plate within a predetermined adjustment range, wherein the adjustment device prevents the hinge arm from falling from the base plate by displacement. The furniture hinge has a fall guard for the hinge arm which prevents the hinge arm from falling relative to the base plate upon uncontrolled displacement of the hinge arm caused by failure of the adjustment device, and the hinge arm is mounted so as to be movable relative to the base plate within the predetermined adjustment range despite the fall guard.

11 Claims, 4 Drawing Sheets

(56) References Cited

U.S. PATENT DOCUMENTS

| | | | | |
|---|---|---|---|---|
| 6,918,158 | B2 | 7/2005 | Isele | |
| 7,117,561 | B1 * | 10/2006 | Domenig et al. | 16/236 |
| 7,213,300 | B1 * | 5/2007 | Domenig et al. | 16/236 |
| 7,231,691 | B1 * | 6/2007 | Domenig et al. | 16/236 |
| 2002/0166207 | A1 * | 11/2002 | Egger et al. | 16/240 |
| 2004/0163212 | A1 | 8/2004 | Isele | |
| 2006/0236503 | A1 | 10/2006 | Migli | |
| 2008/0271292 | A1 * | 11/2008 | Lowe et al. | 16/238 |

FOREIGN PATENT DOCUMENTS

| | | | |
|---|---|---|---|
| EP | 1 236 853 | | 9/2002 |
| FR | 2 296 749 | | 7/1976 |
| GB | 2322667 | A * | 9/1998 |
| JP | 03217571 | A * | 9/1991 |

* cited by examiner

FURNITURE HINGE

BACKGROUND OF THE INVENTION

The present invention concerns a furniture hinge comprising a base plate to be fixed to a furniture carcass and a hinge arm which can be displaced in a controlled manner relative to the base plate by an adjusting device within a predetermined adjusting range, wherein the adjusting device prevents the hinge arm from falling off the base plate due to displacement, wherein the furniture hinge has a safety catcher device for the hinge arm which prevents the hinge arm from falling off relative to the base plate upon an uncontrolled displacement of the hinge arm caused by a failure of the adjusting device.

The invention further concerns an article of furniture comprising at least one furniture hinge of the kind to be described.

Such an adjusting device makes it possible to adjust a door connected to the furniture hinge, in the depth direction, so that therefore it is possible to adjust the spacing of the door relative to the front side of a furniture carcass. The adjusting device for depth adjustment can have a rotatably mounted actuating element, for example in the form of an eccentric screw which is connected to the base plate and which displaces the hinge arm relative to the base plate upon actuation by a user.

A furniture hinge having such an adjusting device is described for example in DE 203 19 539 U1 to the present applicant. The depth adjusting device in an embodiment can have an eccentric screw riveted to the base plate. In the industrial manufacture of such rivet connections however it is quite possible that one rivet connection or the other is not exactly closed. In such a case there is the danger that the eccentric screw can tear loose from the base plate in the mounted position, whereupon the hinge arm is completely detached relative to the base plate, with the further consequence of leading to the door connected to the furniture hinge dropping off. That falling movement on the part of the door leaf can cause injury to people or damage to adjacent objects.

EP 1 236 853 A2 describes a hinge having a two-part base plate formed by a bottom part and a top part. The top part can be moved in the lateral direction relative to the bottom part by way of a height adjusting screw. Arranged on the bottom part is a means for preventing falling-out disengagement in the form of a bendable lug which after mounting of the top side is pressed upwardly and in so doing bears against an associated surface of the top part so that displacement between the bottom part and the top part is no longer possible. That securing means serves to hold the bottom part and the top part in the condition of being connected together even if the height adjusting screw provided is defective. A disadvantage of that structure is that the bent lug no longer permits displacement between the top part and the bottom part.

SUMMARY OF THE INVENTION

Therefore the object of the invention is to provide a furniture hinge of the general kind set forth in the opening part of this specification, avoiding the above-mentioned disadvantage.

According to the invention that is achieved by the features of claim 1. Further advantageous configurations of the invention are recited in the appendant claims.

According to the invention it is therefore provided that the hinge arm is mounted displaceably in spite of the safety catcher device relative to the base plate within the predetermined adjusting range.

By means of the adjusting device, the hinge arm can be displaced in a controlled manner relative to the base plate within a predetermined adjusting range. The hinge arm is held in such a way relative to the base plate so as to prevent it from dropping off, wherein the safety catcher device does not influence adjustment of the hinge arm within that predetermined adjusting range. It is only when the displacement travel of the hinge arm exceeds the predetermined adjusting range—triggered by a defect in the adjusting device (fault in the riveting operation, fracture of a component, an actuating element tearing out of the base plate)—that the safety catcher device prevents the hinge arm (and therewith a door leaf connected to the furniture hinge) being able to become completely detached from the base plate. The safety catcher device therefore makes it possible to limit the maximum displacement travel of the hinge arm relative to the base plate in at least one displacement direction.

After having avoided a crash of the hinge arm from the base plate, the furniture hinge is admittedly defective and has to be replaced, but it is substantially possible to avoid a flap from dropping down, as well as injury resulting therefrom to people or damage to objects—caused by a door leaf dropping down.

In a possible embodiment the safety catcher device has at least one abutment which is arranged on the hinge arm and which upon an uncontrolled displacement of the hinge arm relative to the base plate cooperates with at least one corresponding counterpart abutment of the base plate. In this connection it may be desirable if the hinge arm is connected to a hinge cup by way of at least one pivotal lever, wherein the at least one abutment is arranged at an end of the hinge arm, that is remote from the pivotal lever, and the at least one counterpart abutment is arranged at the end of the base plate, that is towards the pivotal lever.

It is to be noted that at least one intermediate plate can also be arranged between the base plate and the hinge arm. In such a case the safety catcher device can be operative between the hinge arm and the at least one intermediate plate and/or between the hinge arm and the base plate.

The article of furniture according to the invention has at least one furniture hinge of the kind in question.

BRIEF DESCRIPTION OF THE DRAWINGS

Further details and advantages of the present invention are described by means of the specific description hereinafter. In the drawing.

DETAILED DESCRIPTION OF THE PREFERRED EMBODIMENTS

Figure 1:
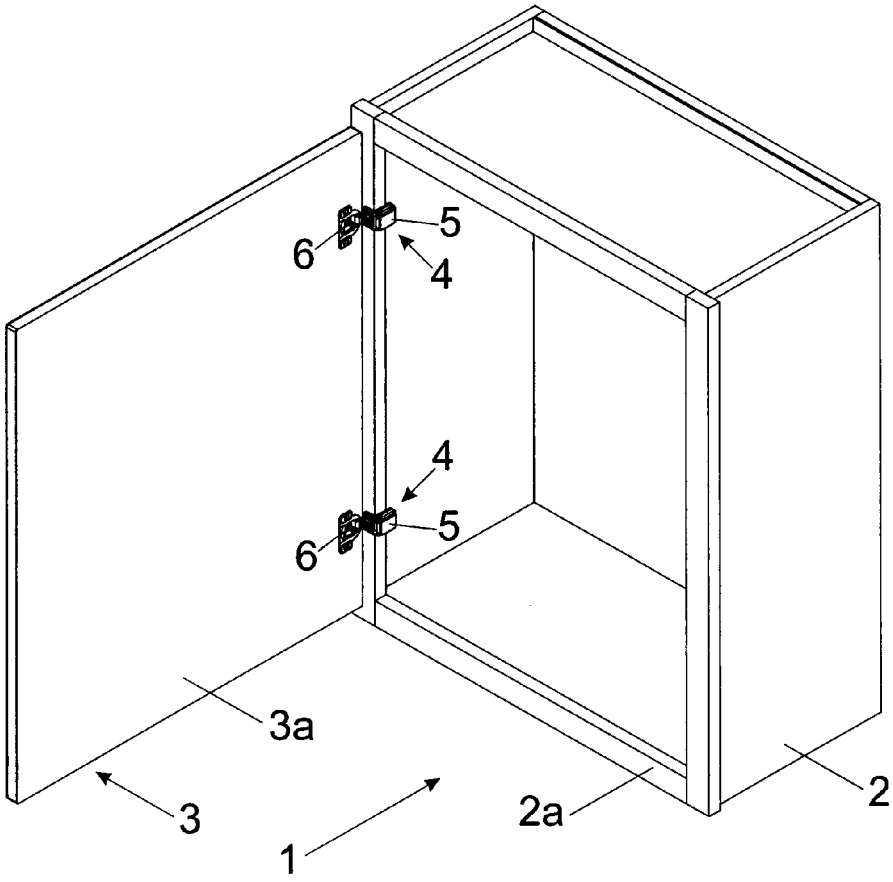
FIG. 1 shows a perspective view of an article of furniture with a door mounted pivotably by way of furniture hinges relative to a furniture carcass.

FIG. 1 shows a perspective view of an article of furniture 1, wherein a movable furniture part 3 in the form of a door 3*a* is pivotally mounted relative to a furniture carcass 2 by way of two or more furniture hinges 4. In known manner, the furniture hinges 4 have a hinge arm 5 to be fixed to a frame 2*a* and a hinge cup 6 pivotally connected to the hinge arm 5. The hinge arm 5 is respectively fixed to the frame 2*a* of the furniture carcass 2 by way of a base plate 7 (not visible here). The hinge cup 6 is counter-sunk as is known per se in a corresponding bore in the door 3*a*.

Figure 2A:
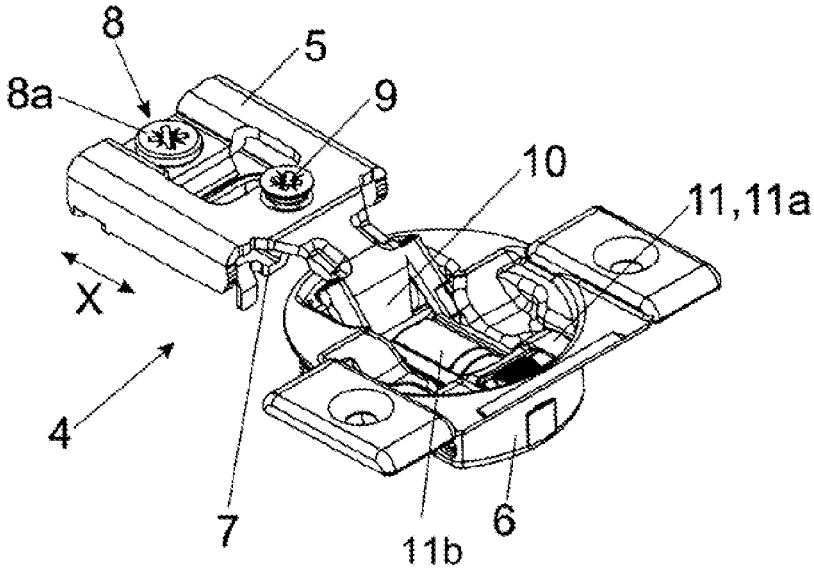
FIGS. 2*a*, 2*b* show two different perspective views of a furniture hinge.

FIG. 2*a* shows a perspective view of a furniture hinge 4 with a base plate 7 to be mounted to the furniture carcass 2 and a hinge arm 5 which is fitted on to the base plate 7 and which is displaceable relative to the base plate 7 in the directions of the illustrated double-headed arrow (X) by way of an adjusting device 8. The adjusting device 8 includes a rotatably mounted actuating element 8*a*, for example in the form of a clamping screw, an eccentric screw or a screw wheel. In addition there is an adjusting wheel 9 by which the front region of the hinge arm 5 can be tilted relative to the base plate 7. Depth adjustment, that is to say the spacing of the door 3*a* relative to the front of the frame 2*a*, is made possible by the adjusting device 8 while transverse adjustment, that is to say the lateral position of the door 3*a* relative to the furniture carcass 2, can be implemented by the adjusting wheel 9. The furniture hinge 4 has a hinge cup 6 which is pivotally connected to the hinge arm 5 by way of at least one pivotal lever 10. In the illustrated embodiment the hinge lever 10 is formed in one piece with the hinge arm 5 and is hingedly connected to the hinge cup 6. The hinge movement can be damped over the last closing travel by a damping device 11 mounted in the hinge cup 6. The damping device 11 has a housing 11*a*, wherein a slider 11*b* is pressed by the pivotal lever 10 into the housing 11*a* towards the end of the closing movement of the furniture hinge 4 against the resistance of a damping fluid, whereby the last closing travel can be damped.

Figure 2B:
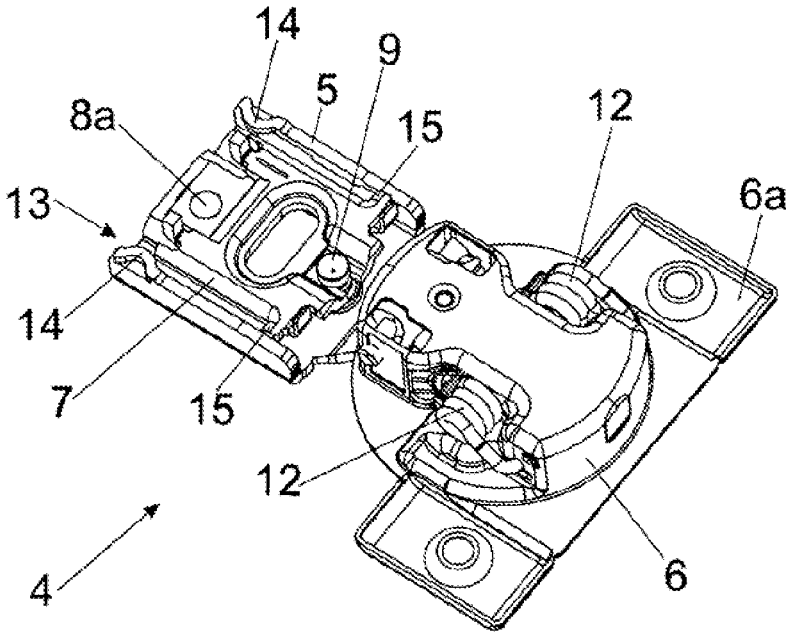

FIG. 2*b* shows a perspective view from below of the furniture hinge 4. The Figure shows a fixing flange 6*a* connected to the hinge cup 6 and a spring device 12, by which the hinge cup 6 is moveable into the completely closed position and/or into the completely open position relative to the hinge arm 5. By manual adjustment of the actuating element 8*a* of the adjusting device 8, the hinge arm 5 can be displaced in a controlled manner relative to the base plate 7 which is fixed to the furniture carcass 2. Also shown is the adjusting wheel 9 for transverse adjustment, which projects into a guide 18 (FIG. 3) of the base plate 7 and is guided displaceably therein. Reference 13 denotes a safety catcher device for the hinge arm 5, wherein in the illustrated embodiment the safety catcher device 13 has at least one abutment 14 which is arranged or formed on the hinge arm 5 and which, in the case of an uncontrolled displacement of the hinge arm 5 relative to the base plate 7—triggered by a defect in the adjusting device 8—which results in an uncontrolled displacement of the hinge arm 5 relative to the base plate 7—cooperates with at least one counterpart abutment 15 on the base plate 7, thereby stopping an uncontrolled displacement of the hinge arm 5 relative to the base plate 7. In that way it is not possible for the hinge arm 5 to be completely detached from the base plate 7. In the illustrated Figure, the hinge arm 5 has two lateral abutments 14 which upon a defect in the adjusting device 8 can respectively cooperate with counterpart abutments 15 on the base plate 7. The abutments 14 on the hinge arm 5 can be produced by an embossing process, wherein the abutments 14 are produced in the form of elevations by a ram being pressed in.

Figure 3:
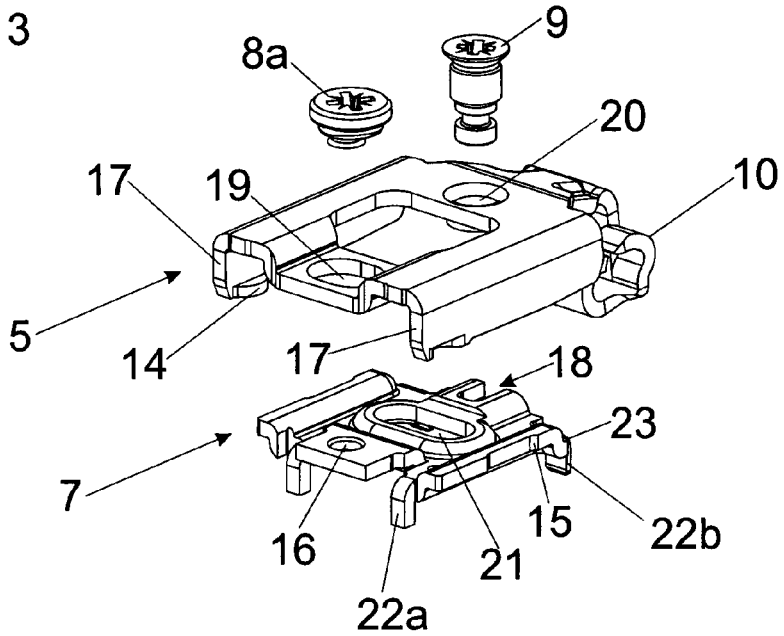
FIG. 3 shows an exploded view of the furniture hinge of FIGS. 2*a* and 2*b*, FIGS. 4*a*; 4*b* show a perspective view of the hinge arm in two opposite end positions relative to the base plate.

FIG. 3 shows an exploded view of the embodiment of FIGS. 2*a* and 2*b*. The base plate 7 has a slot 21 provided for a fixing screw to be screwed into the furniture carcass 2 to pass therethrough. The base plate 7 further has angled limbs 22*a* and 22*b* which are provided for pre-positioning of the furniture hinge 4 and which in the mounted position embrace the front of the frame 2*a* of the furniture carcass 2. The actuating element 8*a* of the adjusting device 8, that projects through the opening 19 in the hinge arm 5, is riveted in the opening 16 of the base plate 7, wherein a shaft of the adjusting wheel 9 is displaceable by adjustment of the actuating element 8*a* within a guide 18 which is preferably open towards a front end of the base plate 7. The adjusting wheel 9 for transverse adjustment projects through the bore 20 in the hinge arm 5, wherein the end of the hinge arm 5, that is towards the pivotal lever 10, can be limitedly raised and lowered by adjustment of the adjusting wheel 9 relative to the front end of the base plate 7. Abutments 14 project in the direction of the base plate 7 from the side limbs 17 of the hinge arm 5, wherein the abutments 14, upon uncontrolled displacement of the hinge arm 5 relative to the base plate 7, butt against corresponding counterpart abutments 15 on the base plate 7, whereby the maximum permissible displacement travel of the hinge arm 5 relative to the base plate 7 is limited.

Figure 4A:
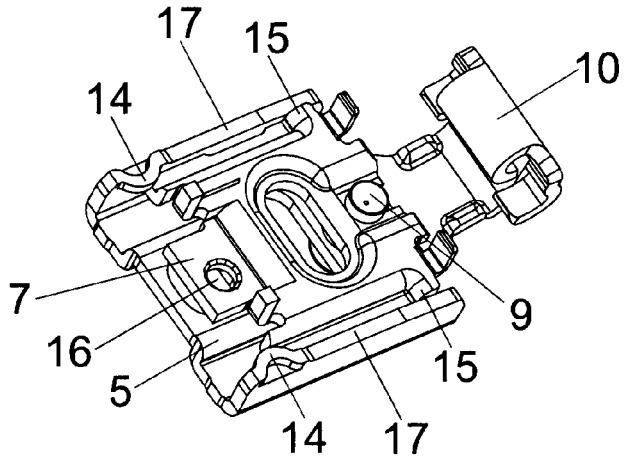
Figure 4B:
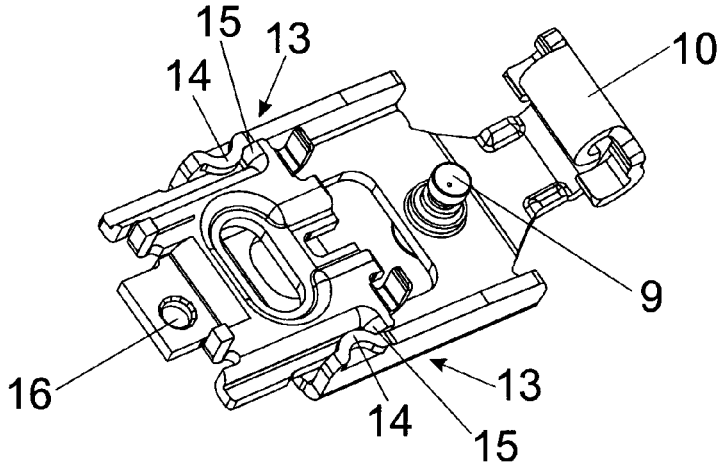

FIG. 4*a* shows the hinge arm 5 arranged on the base plate 7, wherein however the actuating element 8*a* of the adjusting device 8 is missing, which can be caused for example by a defect in riveting the actuating element 8*a* in the opening 16 of the base plate 7. When the hinge arm 5 is moved in the direction of the furniture carcass 2 with the actuating element 8*a* missing (see FIG. 4*a*) that displacement of the hinge arm 5 is stopped by the adjusting screw 9 butting against the bottom of the guide 18. If in contrast the hinge arm 5 is moved in the opposite direction (that is to say out of the furniture carcass 2) (see FIG. 4*b*) the uncontrolled displacement of the hinge arm 5 is stopped by the cooperation of the abutments 14 on the hinge arm 5, with the counterpart abutments 15 of the base plate 7.

Figure 5A:
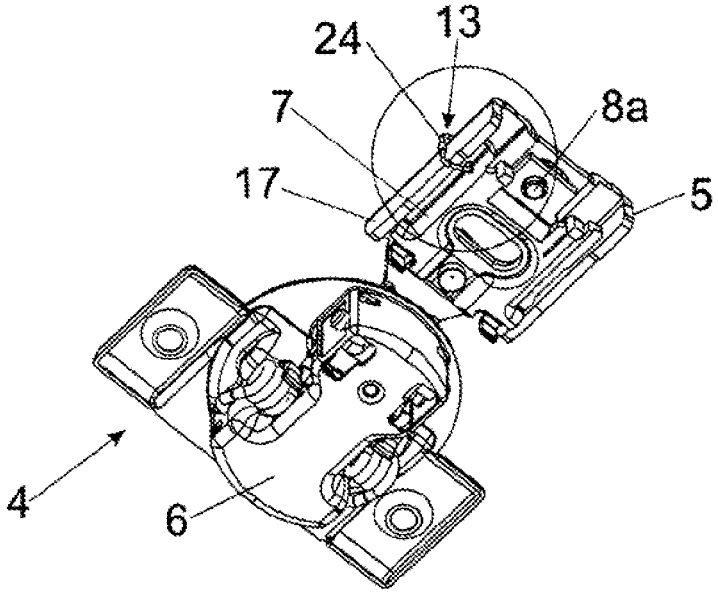
FIGS. 5*a*, 5*b* show a furniture hinge with a safety catcher device according to a further embodiment and an enlarged detail view thereof.
Figure 5B:
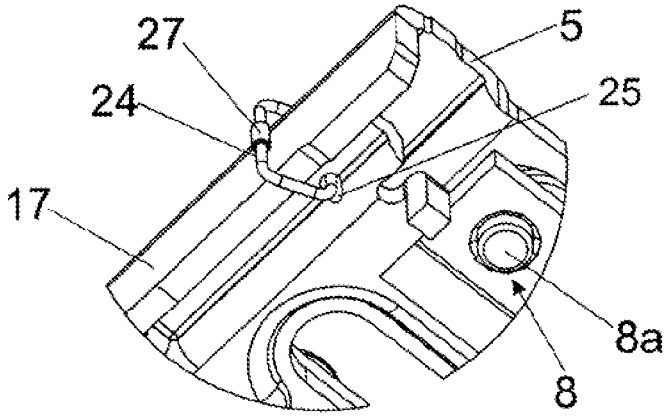

FIG. 5*a* shows a perspective view from below of the furniture hinge 4, showing a further embodiment of a safety catcher device 13. In the illustrated Figure, the safety catcher device 13 for the hinge arm 5 has a bracket 24 which is pivotally mounted to the side limb 17 of the hinge arm 5 and which projects through a bore 25 in the base plate 7. FIG. 5*b* shows an enlarged view of the region circled in FIG. 5*a*, a pivotal mounting 27 arranged on the side limb 17 of the hinge arm 5 being provided for the bracket 24. Thus controlled displacement of the hinge arm 5 relative to the base plate 7 is admittedly possible by rotation of the actuating element 8*a*, but in contrast, upon an uncontrolled displacement of the hinge arm 5, the displacement travel of the hinge arm 5 is stopped by the limited pivotability of the bracket 24 so that the hinge arm 5 cannot slide completely off the base plate 7.

Figure 6A:
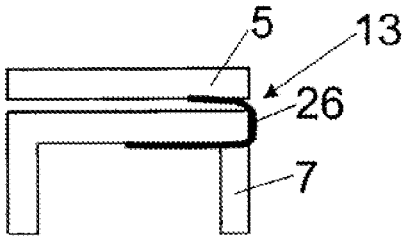
FIGS. 6*a*, 6*b* show highly diagrammatic views of a safety catcher device according to a further embodiment.
Figure 6B:
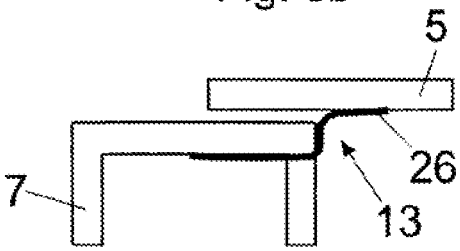

FIGS. 6*a* and 6*b* show in highly diagrammatic form a safety catcher device 13 for the hinge arm 5 in accordance with a further embodiment. In the illustrated Figure the safety catcher device 13 includes a tensile force-resistant band 26 (preferably of metal) anchored on the one hand to the base plate 7 and on the other hand to the hinge arm 5. In an uncontrolled displacement of the hinge arm 5 relative to the base plate 7, the band 26 can be at least partially rolled up (FIG. 6*a*). FIG. 6*b* diagrammatically symbolizes a defect with the adjusting device 8, wherein uncontrolled displacement of the hinge arm 5 is stopped by a stressing position of the band 26.

The present invention does not relate to the illustrated embodiments but includes or extends to all variants and technical equivalents which can fall within the scope of the following claims. The positional references adopted in the description such as for example up, down, lateral and so forth are also related to the directly described and illustrated Figure and are to be appropriately transferred to the new position.

The invention claimed is:

1. A furniture hinge comprising:

a base plate to be fixed to a furniture carcass, a hinge arm which is displaceably mounted relative to said base plate, an adjusting device for displacing said hinge arm relative to said base plate in a controlled manner within a predetermined adjusting range, wherein the adjusting device prevents said hinge arm from falling off said base plate due to displacement, a safety catcher device for said hinge arm which prevents the hinge arm from falling relative to said base plate upon an uncontrolled displacement of the hinge arm caused by a failure of the adjusting device, said hinge arm is mounted displaceably in spite of the safety catcher device relative to the base plate within the predetermined adjusting range, the safety catcher device has at least one abutment which is arranged on the hinge arm and which upon an uncontrolled displacement of the hinge arm relative to the base plate cooperates with at least one corresponding counterpart abutment of the base plate, wherein the at least one abutment is arranged or formed at a side limb of the hinge arm, the at least one abutment is formed as an elevation projecting towards the base plate and that the counterpart abutment of the base plate projects towards the side limb of the hinge arm.

2. The furniture hinge according to claim 1, wherein the hinge arm is connected to a hinge cup by way of at least one pivotal lever, wherein the at least one abutment is arranged at an end of the hinge arm, that is remote from the pivotal lever, and the at least one counterpart abutment is arranged at the end of the base plate, that is towards the pivotal lever.

3. The furniture hinge according to claim 1, wherein the at least one counterpart abutment is arranged or formed laterally on the base plate.

4. The furniture hinge according to claim 1, characterized in that the hinge arm has at least two abutments respectively cooperating with counterpart abutments on the base plate.

5. The furniture hinge according to claim 1, wherein the adjusting device has a rotatably mounted actuating element connected to the base plate.

6. The furniture hinge according to claim 5, wherein the actuating element projects through an opening in the hinge arm.

7. The furniture hinge according to claim 1, wherein the furniture hinge has an adjusting wheel which is separate from the adjusting device and which is guided displaceably by the adjusting device within a guide on the base plate.

8. The furniture hinge according to claim 7, wherein the guide on the base plate is open towards a front end of the base plate.

9. An article of furniture comprising at least one furniture hinge according to claim 1.

10. A furniture hinge comprising:

a base plate to be fixed to a furniture carcass, a hinge arm which is displaceably mounted relative to said base plate, an adjusting device for displacing said hinge arm relative to said base plate in a controlled manner within a predetermined adjusting range, wherein the adjusting device prevents said hinge arm from falling off said base plate due to displacement, a safety catcher device for said hinge arm which prevents the hinge arm from falling relative to said base plate upon an uncontrolled displacement of the hinge arm caused by a failure of the adjusting device, said hinge arm is mounted displaceably in spite of the safety catcher device relative to the base plate within the predetermined adjusting range, wherein the safety catcher device has at least one bracket which is pivotally mounted to the hinge arm and is connected to the base plate and limits an uncontrolled displacement of the hinge arm relative to the base plate.

11. A furniture hinge comprising:

a base plate to be fixed to a furniture carcass, a hinge arm which is displaceably mounted relative to said base plate, an adjusting device for displacing said hinge arm relative to said base plate in a controlled manner within a predetermined adjusting range, wherein the adjusting device prevents said hinge arm from falling off said base plate due to displacement, a safety catcher device for said hinge arm which prevents the hinge arm from falling relative to said base plate upon an uncontrolled displacement of the hinge arm caused by a failure of the adjusting device, said hinge arm is mounted displaceably in spite of the safety catcher device relative to the base plate within the predetermined adjusting range, wherein the safety catcher device has at least one tensile force-resistant band connected on the one hand to the base plate and on the other hand to the hinge arm, wherein the band limits an uncontrolled displacement of the hinge arm relative to the base plate.

* * * * *